US012130015B2

(12) United States Patent
Larsson et al.

(10) Patent No.: US 12,130,015 B2
(45) Date of Patent: Oct. 29, 2024

(54) COMBUSTION CHAMBER WITH WALL COOLING

(71) Applicant: Siemens Energy Global GmbH & Co. KG, Munich (DE)

(72) Inventors: David Larsson, Linkoping (SE); Daniel Lörstad, Ostergotland (SE); Frank Rubensdorffer, Finspang (SE); Magnus Sundholm, Dals Rostock (SE); Simon Svanström, Norrköping (SE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/773,082

(22) PCT Filed: Oct. 2, 2020

(86) PCT No.: PCT/EP2020/077649
§ 371 (c)(1),
(2) Date: Apr. 29, 2022

(87) PCT Pub. No.: WO2021/115658
PCT Pub. Date: Jun. 17, 2021

(65) Prior Publication Data

US 2024/0142104 A1 May 2, 2024

(30) Foreign Application Priority Data

Dec. 10, 2019 (EP) ..... 19214894

(51) Int. Cl.
*F23R 3/50* (2006.01)
*F23R 3/00* (2006.01)
*F23R 3/60* (2006.01)

(52) U.S. Cl.
CPC ..... *F23R 3/005* (2013.01); *F23R 3/002* (2013.01); *F23R 3/50* (2013.01); *F23R 3/60* (2013.01)

(58) Field of Classification Search
CPC .... F23R 3/50; F23R 3/60; F23R 3/002; F23R 3/005
See application file for complete search history.

(56) References Cited

U.S. PATENT DOCUMENTS 3,391,535 A 7/1968 Benjamin
4,379,560 A * 4/1983 Bakken ..... F01D 9/023 415/135

(Continued)

FOREIGN PATENT DOCUMENTS

CN 1034038 A 7/1989
CN 1379170 A 11/2002

(Continued)

OTHER PUBLICATIONS https://web.archive.org/web/20100404144252/https://en.wikipedia.org/wiki/Hagen%E2%80%93Poiseuille_equation; 2010 wikipedia.*

(Continued)

*Primary Examiner* — Todd E Manahan
*Assistant Examiner* — Rodolphe Andre Chabreyrie
(74) *Attorney, Agent, or Firm* — Wolter Van Dyke Davis, PLLC

(57) ABSTRACT

A combustion chamber of a gas turbine, wherein downstream of the combustion chamber an expansion turbine with a turbine inlet is arranged. The combustion chamber has an annular design with a component, which has a chamber wall and an end wall arranged next to the turbine inlet and a corner as connection of the chamber wall and the end wall. To increase the cooling performance the component further has an air guidance piece arranged at a distance (Continued)

from the chamber wall with a cooling channel in-between. Further, the corner is fluid tight, wherein the distance of the air guidance piece to the end wall is at least 0.5-times and at most 2-times the lowest width of the cooling channel.

14 Claims, 1 Drawing Sheet

(56) References Cited

U.S. PATENT DOCUMENTS

| | | | | |
|---|---|---|---|---|
| 5,581,994 | A * | 12/1996 | Reiss | F01D 9/023 60/782 |
| 6,341,485 | B1 | 1/2002 | Liebe | |
| 2002/0148233 | A1 | 10/2002 | Tiemann | |
| 2004/0035115 | A1 | 2/2004 | Farmer | |
| 2006/0032237 | A1 | 2/2006 | Aumont | |
| 2009/0166988 | A1 | 7/2009 | Irmisch | |
| 2011/0135451 | A1 | 6/2011 | Tschuor et al. | |
| 2011/0209482 | A1 | 9/2011 | Toqan | |
| 2014/0223921 | A1 | 8/2014 | Tschuor | |
| 2016/0010867 | A1 | 1/2016 | Gao | |
| 2016/0178207 | A1 | 6/2016 | Bothien | |
| 2018/0017257 | A1 | 1/2018 | Riehle | |
| 2018/0216823 | A1 | 8/2018 | Reynolds | |
| 2019/0162412 | A1 | 5/2019 | Bengtson | |

FOREIGN PATENT DOCUMENTS

| | | | |
|---|---|---|---|
| CN | 1487237 | A | 4/2004 |
| CN | 101189411 | A | 5/2008 |
| CN | 102985758 | A | 3/2013 |
| CN | 104246373 | A | 12/2014 |
| CN | 105258157 | A | 1/2016 |
| CN | 105716116 | A | 6/2016 |
| CN | 107143385 | A | 9/2017 |
| CN | 207962721 | U | 10/2018 |
| CN | 109154438 | A | 1/2019 |
| CN | 110214250 | A | 9/2019 |
| DE | 19629191 | A1 | 1/1998 |
| EP | 3421726 | A1 | 1/2019 |
| EP | 3450851 | A1 | 3/2019 |
| GB | 710287 | A | 6/1954 |
| JP | 2005061725 | A | 3/2005 |
| RU | 2368790 | C2 | 9/2009 |
| WO | 9849496 | A1 | 11/1998 |

OTHER PUBLICATIONS

PCT International Search Report and Written Opinion of International Searching Authority mailed Nov. 1, 2021 corresponding to PCT International Application No. PCT/EP2020/077649 filed Feb. 10, 2020.

* cited by examiner

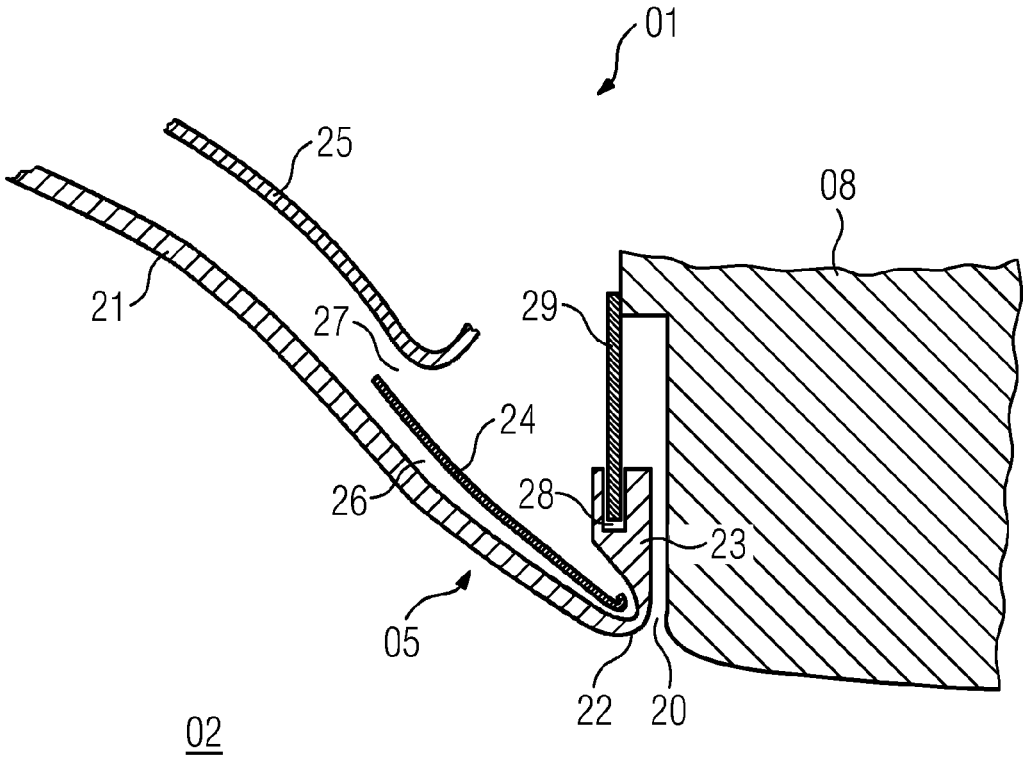
01
25
08
21
27
29
24
26
28
23
05
22
20
02
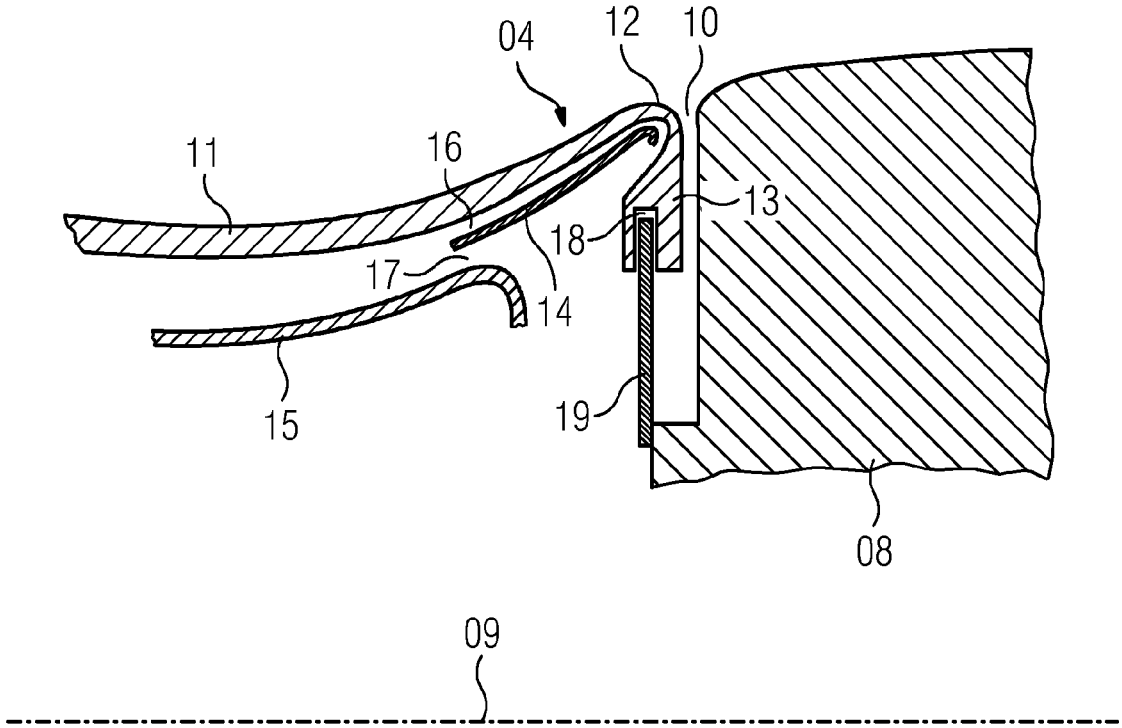
04
12
10
11
16
13
18
17
14
15
19
08
09

COMBUSTION CHAMBER WITH WALL COOLING

CROSS REFERENCE TO RELATED APPLICATIONS

This application is the US National Stage of International Application No. PCT/EP2020/077649 filed 2 Oct. 2020, and claims the benefit thereof. The International Application claims the benefit of European Application No. EP19214894 filed 10 Dec. 2019. All of the applications are incorporated by reference herein in their entirety.

FIELD OF INVENTION

The invention is about an annular combustion chamber of a gas turbine with a chamber wall, which comprises cooling features at the combustion chamber exit.

BACKGROUND OF INVENTION

It is commonly known, that in annular combustion chambers of a gas turbine high temperatures occur, which exceed the allowable temperature for the material of which the chamber wall is made. Therefore, cooling features are usually used. Here it is known to guide compressed air conveyed from the compressor of the gas turbine along the chamber wall of the combustion chamber. An expansion turbine is arranged downstream of the combustion chamber. Especially at the end of the chamber wall in the connection to the expansion turbine it is difficult to ensure a sufficient cooling. As known solution several cooling holes are arranged at the downstream edge of the chamber wall. As result a cooling flow could cross the chamber wall directly into the hot gas path at the connection of the combustion chamber to the expansion turbine.

To increase further the efficiency, it is necessary to prevent as far as possible any loss of cooling air. The task for the current invention is the reduction of the flow of cooling air into the combustion chamber and/or expansion turbine.

SUMMARY OF INVENTION

The solution is solved by the invention according to the claims. A gas turbine with the inventive combustion chamber is also specified. Advantageous solutions are subject of the dependent claims.

The generic combustion chamber of a gas turbine comprises an annular combustion plenum surrounding a rotor-axis. The gas turbine further comprises a number of burners arranged at the upstream side of the combustion chamber and an expansion turbine with a turbine inlet arranged at the downstream side of the combustion chamber.

The combustion chamber is realized by a chamber wall, which comprises an inner chamber wall at the radial inner side of the combustion plenum and an outer chamber wall at the radial outer side of the combustion plenum. It further comprises a headend wall at the upstream side of the combustion plenum, which is not further relevant for the invention. To ensure the stiffness of the chamber wall and to enable the sealing to the expansion turbine the chamber wall further comprises at the downstream end of the chamber plenum an inner end wall extending radially inwards from the downstream end of the inner chamber wall and an outer end wall extending radially outwards from the downstream end of the outer chamber wall both arranged next to the turbine inlet.

To enable the cooling of the chamber wall the combustion chamber further comprises an air guidance piece arranged at a distance from the chamber wall. This leads to the forming of a cooling channel between the chamber wall and the air guidance piece. The cooling channel has a width from the chamber wall to the air guidance piece, which could be constant but also different over the length of the air guidance piece from the downstream end of the combustion chamber to the upstream side.

The area at the end wall starting from the chamber wall is the most critical area regarding overheating. To ensure the sufficient cooling of this area it is necessary for this solution to arrange the air guidance piece at a certain distance to the end wall. In this context it is relevant that the distance from the air guidance piece to the respective end wall needs to be at least the 0.5-times the lowest width of the respective cooling channel width. But the maximum value of 2-times the lowest width of the cooling channel must not be exceeded at a position with the lowest distance from the respective air guidance piece to the respective end wall (the position should be next to the chamber wall). In this context, the lowest distance from the channel wall to the respective air guidance piece is the lowest width of the cooling channel.

To protect the end wall against overheating the common solution comprises a protrusion that continues as extension of the chamber wall. Further usually cooling holes are arranged in the end wall close to the chamber wall or directly in the chamber wall at the end wall.

To avoid an overheating and to spare a cooling air the inventive solution comprises at the chamber wall in connection to the end wall a corner without any protrusion. Further it is necessary that at the corner is fluid tight without any cooling holes.

To enable the necessary cooling of the corner a certain relation between the thickness of the respective chamber wall and the thickness of the corner should be taken into account. Here, it is provided that the thickness of the corner is not more than 2 times of the lowest thickness of the respective chamber wall within the length of the adjacent air guidance piece.

Obviously the same applies for the outer side with the outer chamber wall, the outer end wall and the outer corner as for the inner side with the inner chamber wall, the inner end wall and the inner corner.

In principle with the annular design all parts, that means the inner chamber wall, the outer chamber wall, the inner air guidance piece and the outer air guidance piece and further the inner corner and the outer corner should have a rotatory shape. This results in general in a constant width of the cooling channel in the circumferential direction and also of a constant distance from the air guidance piece to the end wall in the circumferential direction.

If there is any local discrepancy regarding the width of the cooling channel, for example as result of an split of the part into an upper and a lower part, instead of the lowest width of the cooling channel an intermediate distance needs to be taken calculated by the smallest free cross section/flow area (perpendicular to the flow of cooling air within the cooling channel). Analogous, if there is any local discrepancy regarding the distance from the air guidance piece to the end wall, instead of the lowest distance from the air guidance piece to the end wall an intermediate distance needs to be taken calculated by the smallest free cross section/flow area.

The concept of an annular combustion chamber with an annular combustion plenum and therefore an annular inner chamber wall and an annular outer chamber wall two implementations of the inventive solutions are possible. In a first embodiment the combustion chamber comprises an inner air guidance piece which is arranged as described bevor at a fluid tight inner corner. In a second embodiment the combustion chamber comprises an outer air guidance piece which is arranged as described bevor at a fluid tight outer corner. In a third embodiment on the inner side as well as on the outer side an air guidance piece at a respective fluid tight corner is arranged (combination of the first and the second embodiment).

The inventive solution prevents the loss of cooling air. To ensure the cooling of the chamber wall a special arrangement of an air guidance piece at the corner is provided. This enables the cooling of the edge with a flow of cooling air, which could then further used as combustion air.

The wording "downstream" and "upstream" is used always in respect to the direction of the hot gas flowing through the combustion plenum independent if a cooling flow has an opposite direction.

To prevent a local overheating of the chamber wall a sharp edge at the corner should be avoided. Instead it is particularly advantageous that the inner corner respectively the outer corner has a curved shape. This is a disadvantage regarding the guidance of the hot gas flowing from the combustion plenum into the expansion turbine, but the avoidance of the cooling holes in the corner is more beneficial to justify the curved corner.

To enable a beneficial cooling of the corner a more precise relation between the thickness of the chamber wall and the thickness of the corner should be taken into account. Here, it is advantageous if the thickness of the inner corner is not more than 1.5-times of the lowest thickness of the chamber wall within the length of the adjacent inner air guidance piece. Obviously the same applies for the outer corner, as its thickness should advantageously not more than 1.5-times the lowest thickness of the outer chamber wall in the area of the outer air guidance piece. It is particular advantageous, if the thickness of the corner is not more than the lowest thickness of the respective chamber wall within the length of the adjacent air guidance piece.

To enable an advantageous cooling flow at the corner and further between the chamber wall and the air guidance piece along the cooling channel it is advantageous to increase the width of the cooling channel or to keep the width at least constant, that means the distance from the channel wall to the air guidance piece, in the direction from the corner to the upstream side of the combustion plenum.

To enable an advantageous cooling flow at the corner it is further advantageous if the inner air guidance piece has at its end close the inner corner a curved shape off-set from the inner corner and/or if the outer air guidance piece has at its end close the outer corner a curved shape off-set from the outer corner.

A useful fixation of the air guidance piece could be achieved with the arrangement of radial ribs. Therefore, it is advantageous to arrange inner radial ribs between the inner air guidance piece and the inner chamber wall and/or between the inner air guidance piece and the inner end wall. Analogous it is advantageous to arrange outer radial ribs between the outer air guidance piece and the outer chamber wall and/or between the outer air guidance piece and the outer end wall.

To enable a beneficial mounting of a sealing between the combustion chamber and the expansion turbine it is advantageous to arrange an inner seat at the inner end wall at the radial inner side. Here it is particular advantageous to use a radially inwards open groove for mounting an inner sealing. Analogous it is advantageous to arrange an outer seat at the outer end wall at the radial outer side. Here it is particular advantageous to use a radially outwards open groove for mounting an outer sealing.

To enable a sufficient cooling of the chamber wall over the length of the combustion chamber and further to guide additional cooling air along the chamber wall it is further advantageous to arrange an air guidance panel spaced apart from the chamber wall to enable an additional flow of compressed air between the chamber wall and the air guidance panel.

Therefore, advantageously an inner air guidance panel is arranged on the radial inner side of the inner chamber wall. It is further provided, that the inner air guidance panel overlaps on the radial inner side the upstream end of the inner air guidance piece with a short section at the downstream end. This leads to the generation of an inner air inlet as open space between the inner air guidance piece and the inner air guidance panel.

Equally, advantageously an outer air guidance panel is arranged on the radial outer side of the outer chamber wall. It is further provided, that the outer air guidance panel overlaps on the radial outer side the upstream end of the outer air guidance piece with a short section at the downstream end. This leads to the generation of an outer air inlet as open space between the outer air guidance piece and the outer air guidance panel.

The new inventive combustion chamber as described before enables a new inventive gas turbine, which comprises a compressor upstream of the combustion chamber and an expansion turbine downstream of the combustion chamber, wherein the turbine inlet is arranged next to the combustion chamber. Further a number of burners is mounted in the headend of the combustion chamber on the upstream side.

The arrangement of the turbine inlet next to the combustion chamber leads to the existence of an inner gap between the inner corner and the turbine inlet and analog an outer gap between the outer corner and the turbine inlet. To enable the best benefit from the inventive combustion chamber it is advantageous to arrange the turbine inlet in a certain distance to the combustion chamber.

Therefore, it is advantageous to arrange the inner corner in a distance to the turbine inlet at most 0.1-times the distance between the inner corner and the outer corner. It is particular advantageous to limit a width of the inner gap to 0.07-times the distance between the inner corner and the outer corner. Analogous it is advantageous to arrange the outer corner in a distance to the turbine inlet at most 0.1-times the distance between the inner corner and the outer corner. Also, it is particular advantageous to limit a width of the outer gap to 0.07-times the distance between the inner corner and the outer corner.

It is further advantageous to arrange the air guidance piece in a certain distance from the turbine inlet. This leads to a beneficial arrangement with a distance from the inner air guidance piece to the turbine inlet with at least 1.5-times the width of the inner gap. It is analog beneficial to arrange the outer air guidance piece in a distance to the turbine inlet with at least 1.5-time the width of the outer gap. It is particular advantageous, if the distance between the air guidance piece and the turbine inlet is at least 2-times the width of the respective gap.

Here it is further advantageous, if the distance between the air guidance piece and the turbine inlet is not more than 3-times the width of the respective gap. It is particular advantageous, if the distance from the inner air guidance piece to the turbine inlet is at most 2.5-times the width of the inner gap. Again, it is analog particular advantageous, if the distance from the outer air guidance piece to the turbine inlet is at most 2.5-times the width of the outer gap.

This beneficial arrangement of the combustion chamber to the turbine inlet and further the arrangement of the air guidance piece relative to the corner leads to an advantageous cooling effect.

To prevent an unwanted cooling flow in the gap between the combustion chamber and the turbine, more specifically between the inner end wall respectively the outer end wall and the turbine inlet, it is further advantageous to arrange an inner sealing at the inner side between the inner end wall and the turbine inlet and/or an outer sealing between the outer end wall and the turbine inlet. Here the sealing should extend in radial direction and is mounted in the end wall, advantageously in the inner groove respectively in the outer groove.

BRIEF DESCRIPTION OF THE DRAWINGS

The FIGURE shows an example for an inventive combustion chamber.

DETAILED DESCRIPTION OF INVENTION

In the following FIGURE an example for an inventive combustion chamber 01 is shown partly with the (for the invention relevant) area close to the downstream arranged expansion turbine as a section cut. At the bottom of the FIGURE the rotor-axis 09 is shown schematic. The turbine inlet 08 is arranged on the downstream side of the combustion chamber 01, which is shown partly on the right side of the FIGURE. The combustion chamber 01 comprises the combustion plenum 02 in the inside, wherein the combustion chamber 01 with the combustion plenum 02 has an annular shape surrounding the rotor axis 09.

On the radial inner side of the combustion plenum 02 facing the rotor axis 09 the combustion chamber 01 comprises the inner chamber wall 11, wherein on the opposite radial outer side of the combustion plenum 02 the outer chamber wall 21 is arranged. Next to the turbine inlet 08 on the inner side an inner end wall 13 and on the outer side an outer end wall 23 is arranged. Both 13, 23 extend in radial direction, wherein further both 13, 23 comprise an annular groove 18, 28, which 18, 28 opens at the inner side radially inwards and at the outer side radially outwards.

The inner chamber wall 11 with the inner end wall 13 form an inner corner 12 and the outer chamber wall with the outer end wall form an outer corner 22. Here it is advantage that the corner is fluid tight.

The combustion chamber 01 further comprises at a distance from the inner chamber wall 11 at the inner side facing to the rotor axis 09 an inner air guidance piece 14, which 14 extends about parallel to the inner chamber wall 11 with the downstream end close to the inner corner 12. Between the inner chamber wall 11 and the inner air guidance piece 14 an inner cooling channel 16 is build, which extends in the width from the downstream end to the upstream side. Analog on the outer side an outer air guidance piece 24 is arranged on the outer side of the outer chamber wall 21. Again, an outer cooling channel 26 is built between the outer chamber wall 21 and the outer air guidance piece 24 with an increasing width from the downstream end to the upstream side.

Next, partly an inner air guidance panel 15 is shown offset from the inner chamber wall 11 facing the rotor axis 09. The downstream end of the air guidance panel 15 overlaps the upstream end of the air guidance piece 14. In-between an inner air inlet 17 is realized. The same applies again for the outer side. An outer air guidance panel 25 is arranged offset from the outer chamber wall 21 and overlaps the outer air guidance piece 24 with an intermediate outer air inlet 27.

In operation of the gas turbine compressed air as cooling air could flow partly around the air guidance piece 14, 24 along the end wall 13, 23 than along the corner 12, 22 and the chamber wall 11, 21. Another part of the cooling air is introduced through the air inlet 17, 27 to cool the chamber wall 11, 21.

Next an inner sealing 19 and an outer sealing 29 is shown to prevent an uncontrolled cooling flow into the gap 10, 20 between the corner 12, 22 respective the end wall 13, 23 and the turbine inlet 08.

What is shown next is an advantageous shape of the corner 12, 22 with a curved shape and further an advantageous arrangement of the air guidance piece 14, 24 relative to the corner 12, 22 and relative to the turbine inlet 08.

The invention claimed is:

1. A combustion chamber of a gas turbine with an annular combustion plenum surrounding a rotor-axis, wherein a number of burners is arranged intentional at the upstream side of the combustion chamber and an expansion turbine with a turbine inlet is arranged intentional at the downstream side of the combustion chamber, comprising:

an inner component, which is surrounding the rotor-axis at a radial inner side of the combustion plenum and which comprises an inner chamber wall adjacent to the combustion plenum and an inner end wall arranged next to the turbine inlet extending in a radial direction and an inner air guidance piece arranged at a distance from the inner chamber wall with an inner cooling channel in-between, wherein a distance of the inner air guidance piece to the inner end wall is at least 0.5-times and at most 2-times a lowest width of the inner cooling channel, wherein the inner chamber wall is connected to the inner end wall with an inner corner without any protrusion, wherein the inner corner is a continuously curved connection between the inner chamber wall and a downstream facing surface of the inner end wall, the inner corner also bounds the inner cooling channel, and the inner corner is fluid tight, and wherein a greatest thickness of the inner corner is at most 1.2 times a lowest thickness of the inner chamber wall in an area of the inner air guidance piece.

2. The combustion chamber according to claim 1, further comprising:

an outer component, which is surrounding the rotor-axis at a radial outer side of the combustion plenum and which comprises an outer chamber wall adjacent to the combustion plenum and an outer end wall arranged next to the turbine inlet extending in the radial direction and an outer air guidance piece arranged at a distance from the outer chamber wall with an outer cooling channel in-between, and wherein a distance of the outer air guidance piece to the outer end wall is at least 0.5-times and at most 2-times a lowest width of the outer cooling channel, wherein the outer chamber wall is connected to the outer end wall with an outer corner without any protrusion, wherein the outer corner is a continuously curved connection between the outer chamber wall and a downstream facing surface of the outer end wall, the outer corner also bounds the outer cooling channel, and the outer corner is fluid tight, and wherein a greatest thickness of the outer corner is at most 1.2 times a lowest thickness of the outer chamber wall in an area of the outer air guidance piece.

3. The combustion chamber according to claim 2, wherein the greatest thickness of the inner corner is not more than the lowest thickness of the inner chamber wall in the area of the inner air guidance piece; and/or wherein the greatest thickness of the outer corner is not more than the lowest thickness of the outer chamber wall in the area of the outer air guidance piece.

4. The combustion chamber according to claim 2, wherein a width of the inner cooling channel remains constant and/or increases from the inner corner to the upstream side of the combustion chamber; and/or wherein a width of the outer cooling channel remains constant and/or increases from the outer corner to the upstream side of the combustion chamber.

5. The combustion chamber according to claim 2, wherein the inner air guidance piece has a curved shape offset from the inner corner; and/or wherein the outer air guidance piece has a curved shape offset from the outer corner.

6. The combustion chamber according to claim 2, wherein the inner air guidance piece is connected with the inner chamber wall and/or with the inner end wall with inner radial ribs; and/or wherein the outer air guidance piece is connected with the outer chamber wall and/or with the outer end wall with outer radial ribs.

7. The combustion chamber according to claim 2, wherein the inner end wall comprises a radially inwardly open groove for mounting an inner sealing, wherein the radially inwardly open groove is disposed radially inward of and remote from the inner corner; and/or wherein the outer end wall comprises a radially outwardly open groove for mounting an outer sealing, wherein the radially outwardly open groove is disposed radially outward of and remote from the outer corner.

8. The combustion chamber according to claim 2, further comprising an inner air guidance panel offset from the inner chamber wall spaced apart from the inner end wall, wherein the inner air guidance panel overlaps at an end portion thereof an upstream portion of the inner air guidance piece with an inner air inlet in-between; and/or an outer air guidance panel offset from the outer chamber wall spaced apart from the outer end wall, wherein the outer air guidance panel overlaps at an end portion thereof an upstream portion of the outer air guidance piece with an outer air inlet in-between.

9. A gas turbine, comprising:

a compressor, a combustion chamber according to claim 2, a number of burners arranged at the upstream side of the combustion chamber, and an expansion turbine, which comprises a turbine inlet arranged at the downstream side of the combustion chamber.

10. The gas turbine according to claim 9, wherein an inner gap is arranged between the inner corner and the turbine inlet, wherein a width of the inner gap is at most 0.1 times of a distance between the inner corner and the outer corner; and/or wherein an outer gap is arranged between the outer corner and the turbine inlet, wherein a width of the outer gap is at most 0.1 times of the distance between the inner corner and the outer corner.

11. The gas turbine according to claim 9, wherein an inner gap is arranged between the inner corner and the turbine inlet, wherein a distance of the inner air guidance piece to the turbine inlet is at least 1.5-times and at most 3-times a width of the inner gap; and/or wherein an outer gap is arranged between the outer corner and the turbine inlet, wherein a distance of the outer air guidance piece to the turbine inlet is at least 1.5-times and at most 3-times of a width of the outer gap.

12. The gas turbine according to claim 9, wherein an inner sealing is mounted to the inner end wall extending in the radial direction and attached to the turbine inlet at a radial inner portion of the inner sealing; and/or wherein an outer sealing is mounted to the outer end wall extending in the radial direction and attached to the turbine inlet at a radial outer portion of the outer sealing.

13. The combustion chamber according to claim 1, wherein the inner corner turns more than ninety (90) degrees to connect the inner chamber wall with the inner end wall.

14. A combustion chamber of a gas turbine with an annular combustion plenum surrounding a rotor-axis, wherein a number of burners is arranged intentional at the upstream side of the combustion chamber and an expansion turbine with a turbine inlet is arranged intentional at the downstream side of the combustion chamber, comprising:

an outer component, which is surrounding the rotor-axis at a radial outer side of the combustion plenum and which comprises an outer chamber wall adjacent to the combustion plenum and an outer end wall arranged next to the turbine inlet extending in radial direction and an outer air guidance piece arranged at a distance from the outer chamber wall with an outer cooling channel in-between, and wherein a distance of the outer air guidance piece to the outer end wall is at least 0.5-times and at most 2-times a lowest width of the outer cooling channel, wherein the outer chamber wall is connected to the outer end wall with an outer corner without any protrusion, wherein the outer corner is a continuously curved connection between the outer chamber wall and a downstream facing surface of the outer end wall, the outer corner also bounds the outer cooling channel, and the outer corner is fluid tight, and wherein a greatest thickness of the outer corner is at most 1.2 times a lowest thickness of the outer chamber wall in an area of the outer air guidance piece.

* * * * *